US008491267B2

(12) United States Patent
Glasspoole et al.

(10) Patent No.: US 8,491,267 B2
(45) Date of Patent: Jul. 23, 2013

(54) RETAINING RING ARRANGEMENT FOR A ROTARY ASSEMBLY

(75) Inventors: David F. Glasspoole, St. Lambert (CA); Bruno Chatelois, Boucherville (CA)

(73) Assignee: Pratt & Whitney Canada Corp., Longueuil, Québec ( * ) Notice: Subject to any disclaimer, the term of this patent is extended or adjusted under 35 U.S.C. 154(b) by 508 days.

(21) Appl. No.: 12/870,131

(22) Filed: Aug. 27, 2010

(65) Prior Publication Data

US 2012/0051918 A1 Mar. 1, 2012

(51) Int. Cl.
*F01D 5/30* (2006.01)

(52) U.S. Cl.
USPC ..... 416/221; 416/244 A

(58) Field of Classification Search
USPC ..... 416/220 R, 221, 244 A; 415/199.5, 415/173.1, 115
See application file for complete search history.

(56) References Cited

U.S. PATENT DOCUMENTS

| | | | | |
|---|---|---|---|---|
| 3,096,074 | A | 7/1963 | Pratt et al. | |
| 3,888,602 | A | 6/1975 | Nichols et al. | |
| 3,904,316 | A | 9/1975 | Clingman et al. | |
| 4,019,833 | A | 4/1977 | Gale | |
| 4,255,086 | A | 3/1981 | Roberts | |
| 4,304,523 | A | 12/1981 | Corsmeier et al. | |
| 4,339,229 | A | 7/1982 | Rossman | |
| 4,349,318 | A | 9/1982 | Libertini et al. | |
| 4,397,609 | A | 8/1983 | Kochendorfer | |
| 4,470,756 | A | 9/1984 | Rigo et al. | |
| 4,521,160 | A | 6/1985 | Bouiller et al. | |
| 4,730,983 | A | 3/1988 | Naudet et al. | |
| 5,263,823 | A | 11/1993 | Cabaret et al. | |
| 5,281,098 | A | 1/1994 | Glynn et al. | |
| 5,302,086 | A | 4/1994 | Kulesa et al. | |
| 6,533,550 | B1 | 3/2003 | Mills | |
| 7,306,433 | B2 | 12/2007 | Klingels et al. | |
| 2003/0017050 | A1 * | 1/2003 | Simeone et al. | 416/96 R |
| 2006/0216143 | A1 * | 9/2006 | Trinks et al. | 415/173.1 |
| 2007/0108762 | A1 * | 5/2007 | Buschmann et al. | 285/322 |

* cited by examiner

*Primary Examiner* — Edward Look
*Assistant Examiner* — William Grigos
(74) *Attorney, Agent, or Firm* — Norton Rose Fulbright Canada

(57) ABSTRACT

A retaining ring arrangement is provided for axially holding a component on a rotating component of a gas turbine engine. The retaining ring arrangement comprises a split retaining ring mounted in a circumferential groove defined in a radially outer surface of the rotating component. The inner diameter of the retaining ring is biased inwardly in radial contact with a radially outer facing seat provided on one of the two components to be assembled. An anti-rotation feature is provided at the inner diameter of the retaining ring for restraining the ring against rotation. A sleeve surrounds the retaining ring to limit radial expansion thereof when subject to centrifugal forces during engine operation.

15 Claims, 6 Drawing Sheets

RETAINING RING ARRANGEMENT FOR A ROTARY ASSEMBLY

TECHNICAL FIELD

The application relates generally to a gas turbine engine rotary assembly and, more particularly, to a retaining ring arrangement for axially retaining a first component on a second rotary component.

BACKGROUND OF THE ART

Retaining rings used in turbine assemblies are generally loaded radially outwardly in an inside diameter groove. The ring has to be collapsed in to allow the assembly of the part to be retained. If the ring is not flexible enough, the ring may plastically deformed and, thus, jeopardize the integrity of the assembly. In use, rotation of the retaining ring in the inside diameter groove may cause premature wear of the ring.

There is thus a need for a new retaining ring arrangement providing flexibility and safety in the handling and transportation of a rotary assembly during manufacture and overhaul.

SUMMARY

In one aspect, there is provided a gas turbine engine rotary assembly comprising: a first component mounted for rotation about an axis of the gas turbine engine, a second component mounted on said first component, a retaining ring received in a circumferential groove defined in a radially outer surface of the first component, the retaining ring providing an axially facing shoulder for axially retaining the second component onto the first component, the retaining ring having at an inner diameter thereof a radially inner surface defining a plurality of circumferentially spaced-apart grooves for engagement with at least one anti-rotation lug projecting from one of said first and second components, thereby restraining the retaining ring against rotation relative to said one of the first and second components, the retaining ring having a split ring body which is spring-loaded radially inwardly at said inner diameter against a circumferential seat provided on a radially outer surface of one of said first and second components, and an outer sleeve surrounding the split ring body to limit radial expansion of the split ring body and thereby prevent disengagement of the anti-rotation lug from the split ring body as a result of centrifugal forces transferred to the retaining ring during gas turbine engine operation.

In a second aspect, there is provided a retaining ring arrangement for axially holding a coverplate on a turbine disc mounted for rotation about a central axis of a gas turbine engine, the retaining ring arrangement comprising: a split retaining ring mounted in a circumferential groove defined in a radially outer surface of the turbine disc, the inner diameter of the split retaining ring being biased inwardly in radial contact with a radially outer facing seat provided on one of the coverplate and the turbine disc, an anti-rotation feature provided at said inner diameter of the split retaining ring for restraining the split retaining ring against rotation, and a sleeve surrounding the split retaining ring to limit radial expansion thereof when subject to centrifugal forces during operation of the gas turbine engine.

DESCRIPTION OF THE DRAWINGS

Reference is now made to the accompanying figures, in which.

DETAILED DESCRIPTION OF THE PREFERRED EMBODIMENTS

Figure 1:
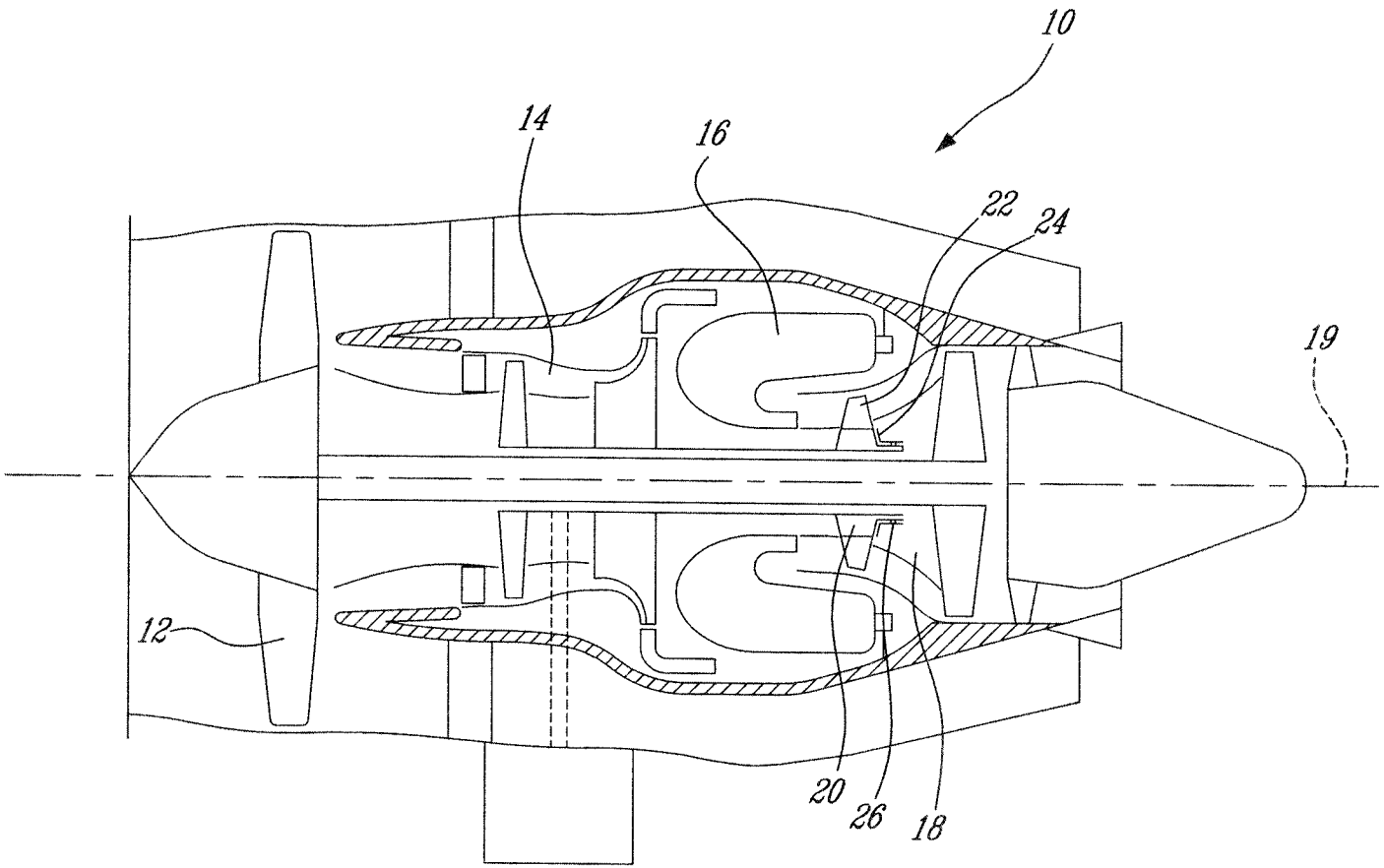
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

As schematically illustrated in FIG. 1, the turbine section 18 comprises a turbine disc 20 mounted for rotation about the engine centerline 19. The turbine disc 20 carries a circumferential array of turbine blades 22 which extend into the gaspath downstream of the combustor 16. A coverplate 24 covers the aft face of the turbine disc 20. A retaining ring 26 is used to axially retain the coverplate 24 on the turbine disc 20.

Figure 2:
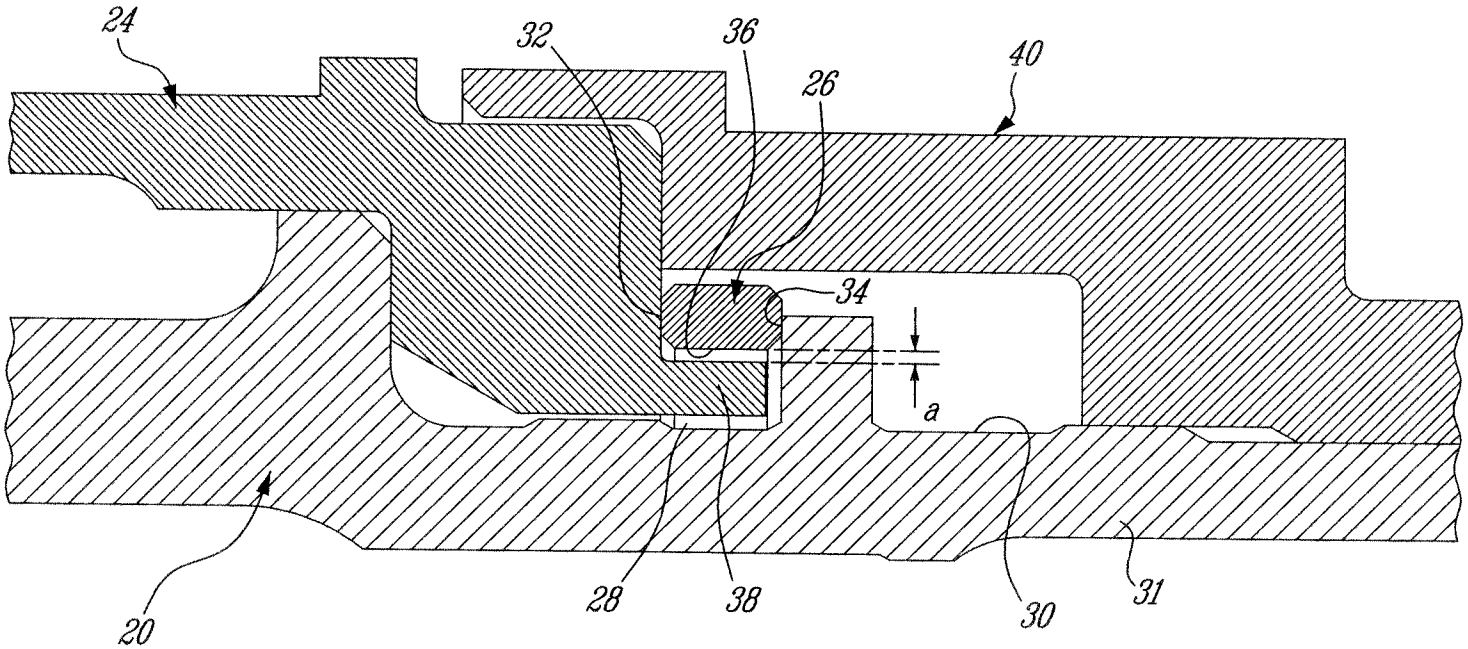
FIG. 2 is an enlarged cross-sectional view of part of a coverplate axially retained on a turbine disc by a retaining ring.

As shown in FIG. 2, the retaining ring 26 is mounted in a circumferential groove 28 defined in a radially outer surface 30 of an axially extending shaft portion 31 of the turbine disc 20. The retaining ring 26 offers an axially facing shoulder 32 against which the coverplate 24 is abutted. The rear axially facing sidewall 34 of the circumferential groove 28 provides an arresting or abutting surface against which the ring 26 abuts or rests to axially hold the coverplate 24 in position on the turbine disc 20. Accordingly, the coverplate 24 is axially loaded against the retaining ring 26 which is, in turn, axially loaded against wall 34 of the circumferential groove 28 of the turbine disc 20.

Figure 3:
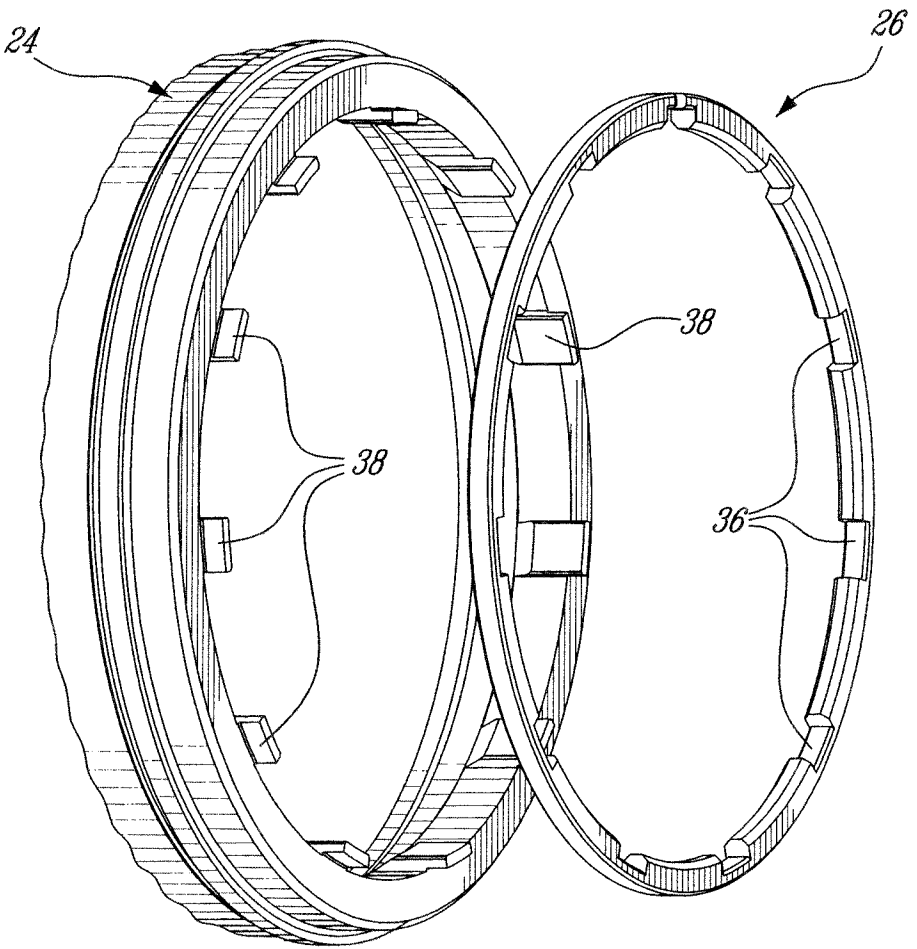
FIG. 3 is an isometric fragmented view of a rear part of the turbine disc coverplate and of the retaining ring shown in FIG. 2.
Figure 4:
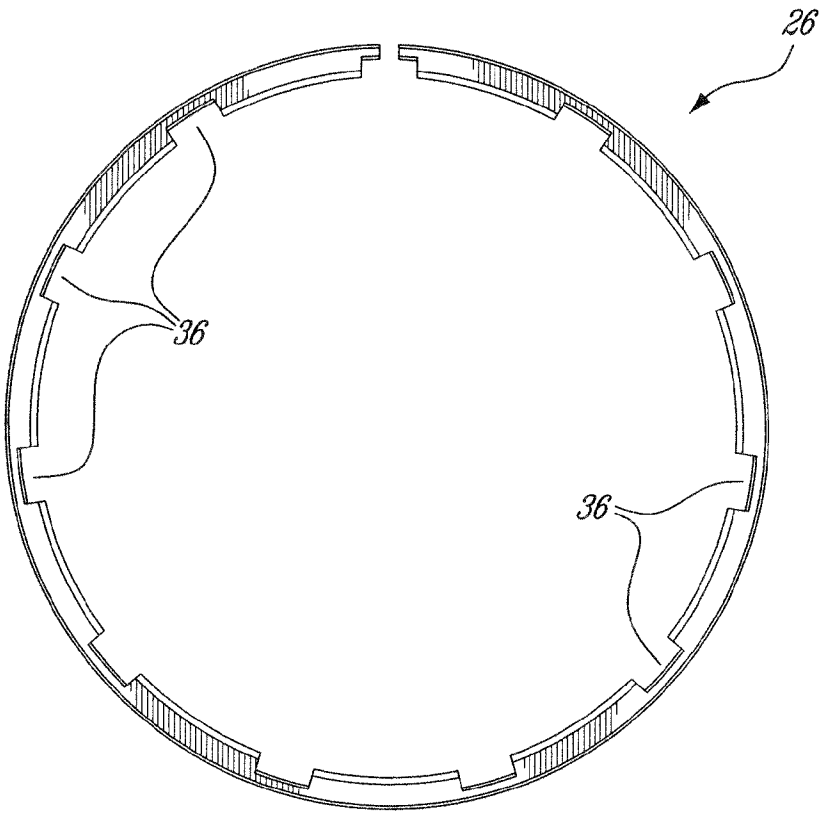
FIG. 4 is a front view of the retaining ring.

As shown in FIGS. 3 and 4, the retaining ring 26 may be provided in the form of an external split ring of relatively small cross-sectional area. The retaining ring 26 is designed to be elastically expanded over the shaft portion 31 of the turbine disc 20, put in place, and allowed to snap back radially inwardly towards its unstressed/rest position into the groove 28. An array of circumferentially spaced-apart grooves 36 are defined in the inside diameter of the ring 26. The grooves 36 provide added flexibility for deformation at assembly as compared to a ring having a complete inside diameter surface. The grooves 36 are also provided for engagement with a corresponding array of anti-rotation lugs 38 projecting axially rearwardly from the coverplate 24. The grooves 36 may be cut or otherwise formed into the radially inner facing surface of the inside diameter of the ring 26.

As shown in FIG. 2, the lugs 38 extend axially into the circumferential groove 28 of the turbine disc 20 and into the grooves 36 of the retaining ring 26 to lock the ring 26 against rotation relative to the coverplate 24. The circumferentially opposed end walls of each groove 36 provide arresting surfaces for the lugs 38 in the circumferential direction. The radially inner bottom surface of the grooves 36 are radially spaced from the lugs 38 (see radial gap "a" in FIG. 2). In other words, the ring 26 does not radially contact the lugs 38 on the coverplate 24. The ring 26 is rather radially inwardly loaded and centralized on the radially outer bottom surface of the circumferential groove 28. Indeed, according to the embodiment illustrated in FIG. 2, the ring 26 is centrally located on the turbine disc assembly by spring-loading the surface of the inside diameter of the ring 26 between adjacent grooves 36 in radial contact with the bottom surface of the circumferential groove 28 of the turbine disc 20 (i.e. the inside diameter of the ring 26 at rest is smaller than the diameter of the shaft portion of the turbine disc 20 in groove 28).

An outer sleeve 40 surrounds the retaining ring 26 to limit the radial expansion of the ring 26 when subject to centrifugal forces during engine operation. The outer sleeve 40 and the radial height of the grooves 36 are such that when the ring 26 opens during engine operation and contact the outer sleeve 40, the anti-rotation lug-groove contact is maintained at all time. The outer sleeve 40 may be threadably mounted or otherwise detachably secured to the turbine disc 20.

According to the installation procedure, the coverplate 24 is first installed on the disc 20 prior to the ring 26 being snapped in. After the coverplate 24 has been properly positioned on the disc 20, the retaining ring 26 is elastically expanded over the shaft portion 31 of disc 20 and positioned in the circumferential groove 28 with the inside diameter grooves 36 of the ring 26 aligned with the lugs 38. Then, the ring 26 is allowed to snap back towards its rest position in radial seating contact against the bottom surface of the circumferential groove 28, thereby both centralizing the ring and restraining the ring against rotation.

Figure 5:
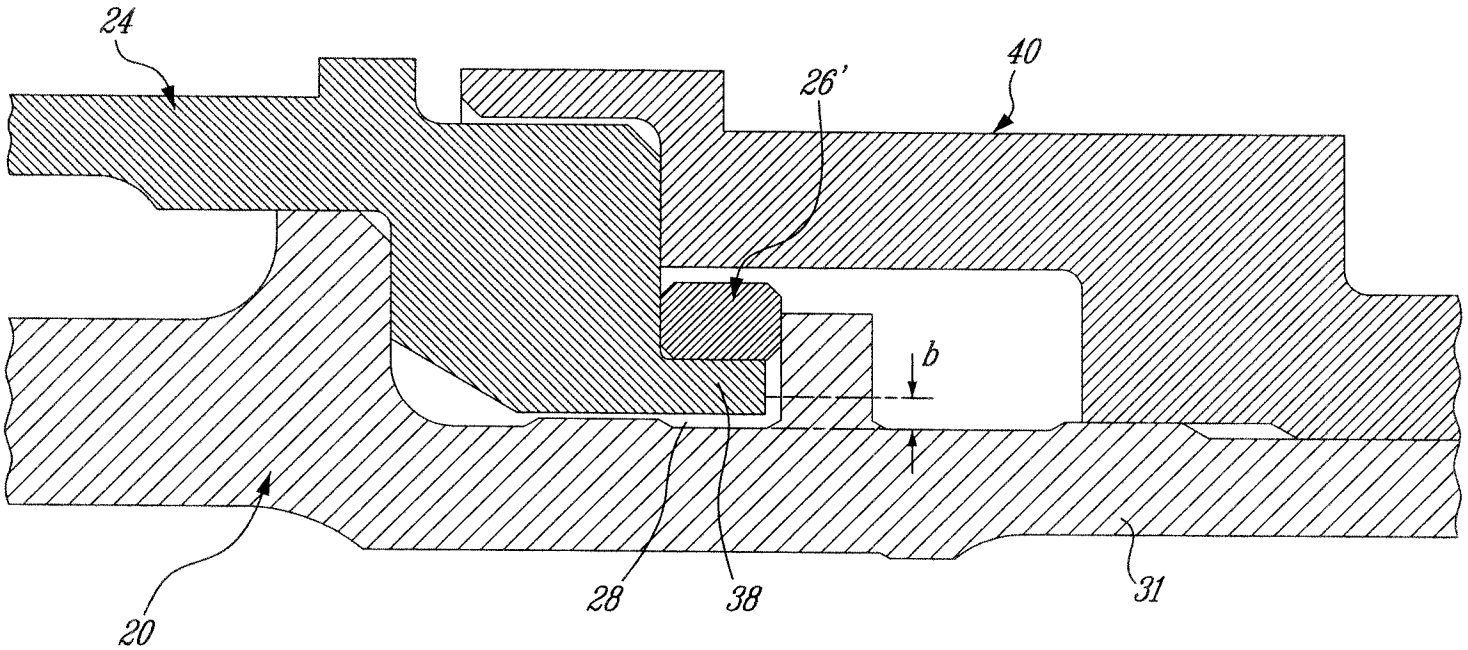
FIG. 5 is an enlarged cross-sectional view of another embodiment of a retaining ring arrangement for axially retaining a coverplate on a turbine disc of a gas turbine engine.
Figure 6:
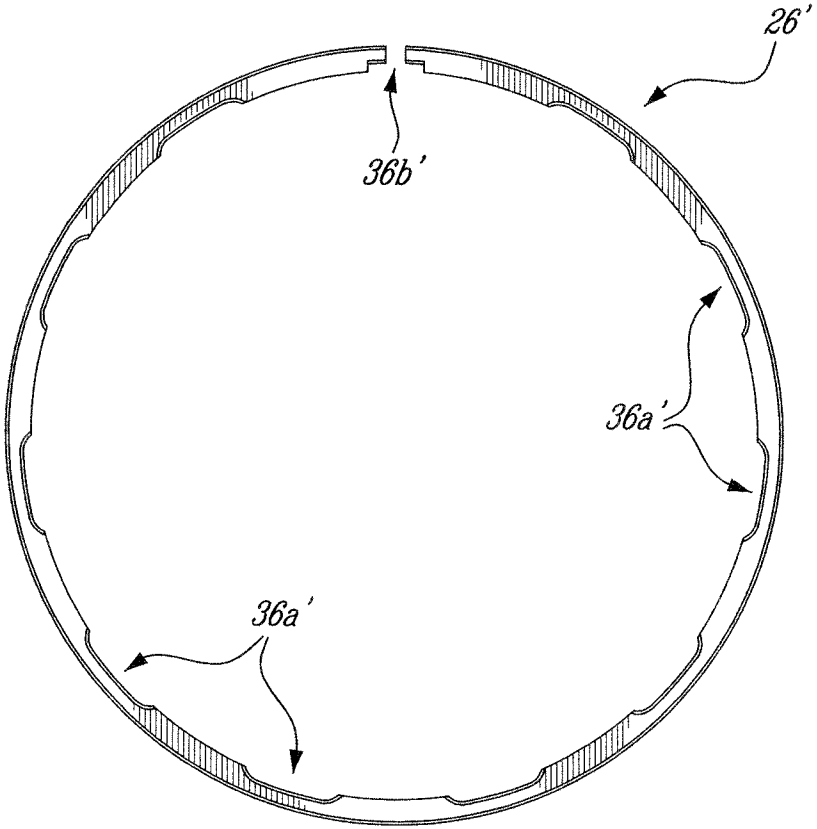
FIG. 6 is a front view of the retaining ring shown in FIG. 5.

FIGS. 5 and 6 show another external retaining ring arrangement in which a split retaining ring 26' is centralized and positively radially seated on the lugs 38 projecting from the coverplate 24 rather than on the bottom of the circumferential groove 28 defined in the radially outer surface 30 of the turbine disc 20. Once positioned in the groove 28, the ring 26' snaps back towards its rest position radially inwardly against the radially outer surface of the lugs 38. There is no contact between the ring inside diameter and the outside diameter of the disc 20 in the groove 28 (see radial gap "b" in FIG. 5). The ring 26' is "floatingly" mounted in the circumferential groove 28 and centralized by the lugs 38. This allows the ring 26' to have a smaller cross-section than the ring 26 shown in FIGS. 2 to 4.

As shown in FIG. 6, the grooves in the inside diameter surface of ring 26' may include two types of grooves: centralization grooves 36*a*' and anti-rotation grooves 36*b*'. In the illustrated embodiment, only one anti-rotation groove 36*b*' is defined at the split in the ring 26'. However, it is understood that more than one anti-rotation groove 36*b*' could be provided. The two types of grooves have a different shape or profile. The centralization grooves 36*a*' are generally wider in the circumferential direction and have larger corner radii than that of the anti-rotation grooves 36*b*' in order to reduce stresses induced in the ring 26' during installation. The circumferentially opposed end walls of the anti-rotation grooves 36'*a* extends generally at right angles from the bottom surface of the grooves to provide for proper abutting or arresting surfaces for the coverplate lugs 38 in the circumferential direction. The bottom surface of both types of grooves 36*a*' and 36*b*' are located on a same inside diameter for radial engagement with the outside diameter surface of the lugs 38. When installed, the radially inner bottom surface of the grooves 36*a*' and 36*b*' is positively seated against the radially outer surface of the coverplate lugs 38, thereby centrally locating the ring 26' relative to the coverplate 24.

The above description is meant to be exemplary only, and one skilled in the art will recognize that changes may be made to the embodiments described without departing from the scope of the invention disclosed. For example, it is understood that the above described retaining ring designs can be used on a wide variety of rotary assembly and is thus not limited to a turbine disc and coverplate assembly. Also it is understood that the anti-rotation lugs could be provided on either one of the two parts being assembled together. For instance, an anti-rotation lug could be provided in the circumferential groove of the turbine disc. Also, depending on the applications, the number of anti-rotation lugs and grooves may vary. It is contemplated to use a single anti-rotation lug and a single anti-rotation groove. Also, the anti-rotation features provided at the inside diameter of the radially inwardly spring-loaded ring could take various forms and is thus not limited to a lug and groove arrangement. Any suitable interlocking features could be used. It is also understood that the same lugs could be used to both centralized and restrain the ring against rotation. Still other modifications which fall within the scope of the present invention will be apparent to those skilled in the art, in light of a review of this disclosure, and such modifications are intended to fall within the appended claims.

What is claimed is:

1. A gas turbine engine rotary assembly comprising: a first component mounted for rotation about an axis of the gas turbine engine, a second component mounted on said first component, a retaining ring received in a circumferential groove defined in a radially outer surface of the first component, the retaining ring providing an axially facing shoulder for axially retaining the second component onto the first component, the retaining ring having at an inner diameter thereof a radially inner surface defining a plurality of circumferentially spaced-apart grooves for engagement with at least one anti-rotation lug projecting from one of said first and second components, thereby restraining the retaining ring against rotation relative to said one of the first and second components, the retaining ring having a split ring body which is spring-loaded radially inwardly at said inner diameter against a circumferential seat provided on a radially outer surface of one of said first and second components, and an outer sleeve surrounding the split ring body to limit radial expansion of the split ring body and thereby prevent disengagement of the anti-rotation lug from the split ring body as a result of centrifugal forces transferred to the retaining ring during gas turbine engine operation.

2. The gas turbine engine rotary assembly defined in claim 1, wherein the anti-rotation lug forms part of a set of circumferentially spaced-apart lugs extending axially from the second component into the circumferential groove defined in the radially outer surface of the first component and into the circumferentially spaced-apart grooves of the retaining ring, and wherein a radially inner facing surface of each of the circumferentially spaced-apart grooves of the retaining ring is biased in radial seating contact with a corresponding radially outer facing surface of each of said circumferentially spaced-apart lugs of the second component, thereby providing for the centralization of the retaining ring by the circumferentially spaced-apart lugs.

3. The gas turbine engine rotary assembly defined in claim 2, wherein the radially inner surface of the retaining ring between the circumferentially spaced-apart grooves is spaced radially from a bottom surface of the circumferential groove defined in the first component, thereby allowing the retaining ring to be floatingly received in the circumferential groove.

4. The gas turbine engine rotary assembly defined in claim 2, wherein the circumferentially spaced-apart grooves in the radially inner surface of the retaining ring includes centralizing grooves and at least one anti-rotation groove, the centralizing grooves and the at least one anti-rotation groove having a different profile, the centralizing grooves having larger corner radii than the at least one anti-rotation groove.

5. The gas turbine engine rotary assembly defined in claim 1, wherein the circumferential seat comprises a radially outer facing bottom surface of the circumferential groove defined in the first component, and wherein the split ring body is positively seated in radial contact with the radially outer facing bottom surface of the circumferential groove.

6. The gas turbine engine rotary assembly defined in claim 5, wherein the anti-rotation lug forms part of a set of circumferentially spaced-apart lugs extending axially from the second component, the circumferentially spaced-apart lugs being received in said circumferentially spaced-apart grooves at the inner diameter of the retaining ring, and wherein there is no radial contact between the circumferentially spaced-apart lugs and the split ring body.

7. The gas turbine engine rotary assembly defined in claim 1, wherein the first component is a turbine disc and the second component a coverplate.

8. A retaining ring arrangement for axially holding a coverplate on a turbine disc mounted for rotation about a central axis of a gas turbine engine, the retaining ring arrangement comprising: a split retaining ring mounted in a circumferential groove defined in a radially outer surface of the turbine disc, the inner diameter of the split retaining ring being biased inwardly in radial contact with a radially outer facing seat provided on one of the coverplate and the turbine disc, an anti-rotation feature provided at said inner diameter of the split retaining ring for restraining the split retaining ring against rotation, and a sleeve surrounding the split retaining ring to limit radial expansion thereof when subject to centrifugal forces during operation of the gas turbine engine.

9. The retaining ring arrangement defined in claim 8, wherein the inner diameter of the split retaining ring is provided with an array of circumferentially spaced-apart grooves.

10. The retaining ring arrangement defined in claim 9, wherein said array of circumferentially spaced-apart grooves comprises a set of centralization grooves, the centralization grooves having a radially inwardly facing bottom biased in radial contact with the radially outer facing seat, the radially outer facing seat comprising a set of circumferentially spaced-apart centralization lugs projecting axially from the coverplate into the circumferential groove defined in the turbine disc.

11. The retaining ring arrangement defined in claim 8, wherein the anti-rotation feature includes at least one groove defined in the inner diameter of the split retaining ring, the at least one groove receiving an anti-rotation lug extending axially from one of the turbine disc and the coverplate.

12. The retaining ring arrangement defined in claim 10, wherein surface segments of the inner diameter of the split retaining ring between adjacent centralization grooves are spaced radially from a bottom surface of the circumferential groove defined in the radially outer surface of the turbine disc, thereby allowing the split retaining ring to be floatingly received in said circumferential groove.

13. The retaining ring arrangement defined in claim 11, wherein the anti-rotation lug extends axially from the coverplate into the circumferential groove defined in the turbine disc for engagement in the at least one groove defined in the inner diameter of the split retaining ring.

14. The retaining ring arrangement defined in claim 8, wherein said anti-rotation feature comprises a set of circumferentially spaced-apart grooves defined in the inner diameter of the split retaining ring, and wherein a corresponding set of anti-rotation lugs project axially from the coverplate into the circumferential groove defined in the turbine disc for engagement in said circumferentially spaced-apart grooves at the inner diameter of the split retaining ring.

15. The retaining ring arrangement defined in claim 14, wherein each of the circumferentially spaced-apart grooves has a radially inwardly facing bottom surface which is spaced radially from an associated one of the anti-rotation lugs, and wherein the radially outer facing seat is provided by a radially outer facing bottom surface of the circumferential groove defined in the turbine disc, the surface of the inner diameter of the split retaining ring between the circumferentially spaced-grooves being positively radially seated against the radially outwardly facing bottom surface of the circumferential groove.

* * * * *